United States Patent [19]

Bolieau

[11] Patent Number: 4,793,257

[45] Date of Patent: Dec. 27, 1988

[54] SAFETY AND ARMING MECHANISM

[75] Inventor: Christopher W. Bolieau, Brigham City, Utah

[73] Assignee: Morton Thiokol, Inc., Chicago, Ill.

[21] Appl. No.: 39,185

[22] Filed: Apr. 16, 1987

[51] Int. Cl.[4] ..... F42C 15/40

[52] U.S. Cl. ..... 102/221; 102/262; 102/264

[58] Field of Search ..... 102/215, 262, 264, 221, 102/222, 254, 256, 255, 248, 244, 232, 238

[56] References Cited

U.S. PATENT DOCUMENTS

| | | | |
|---|---|---|---|
| 3,181,467 | 5/1965 | Jacob et al. | 102/248 |
| 4,188,885 | 2/1980 | Wolf et al. | 102/221 |
| 4,320,389 | 3/1982 | Caruso | 102/262 X |
| 4,337,701 | 7/1982 | Janson | 102/264 X |
| 4,635,552 | 1/1987 | Battle | 102/262 X |

*Primary Examiner*—David H. Brown

*Attorney, Agent, or Firm*—Gerald K. White

[57] ABSTRACT

A safe and arm device is responsive to electrical signals by way of two solenoids that push and pull, respectively, an arm to rotate, in turn, each of a series of three cogwheels by steps. When each of the cogwheels has been rotated a given number of steps prescribed by a secret code, slots or cutouts in each of the cogwheels are aligned to permit passage therethrough of an elongated bar or rack that can then operate or enable a switch or other mechanism to fire a rocket motor, etc.

19 Claims, 2 Drawing Sheets

SAFETY AND ARMING MECHANISM

BACKGROUND OF THE INVENTION

1. Field of the Invention

This invention relates to an electromechanical device which functions upon application thereto of a preset coded input signal to allow arming for firing a rocket motor or other propulsion or explosive mechanism.

2. Description of the Prior Art

Various safety and arming devices have been proposed in the prior art for preventing accidental arming and premature ignition of ordnance missile and other systems. The ignition of flares or the explosion of bombs or rockets during handling, shipping or in storage creates a highly hazardous situation.

Safety and arming mechanisms are known which enable the arming of a weapon, propulsion or other system electrically or mechanically. Electrical arming may be accomplished by shunting a circuit through a pair of terminals or by moving a lever to close a switch. Mechanical arming may be accomplished by an action such as moving two or more explosive elements into alignment or removing a barrier from between a pair of explosive elements.

Forms of safety and arming devices have been proposed which will not function unless subjected to an acceleration above a predetermined minimum, properly directed and sustained for a predetermined interval.

Other forms of safety and arming devices are known which must accept a particular preset coded input signal to function, and which when the correct signal is sent will allow arming. One form of such device constitutes an electrical switch requiring a complex code. Another form comprises a mechanical structure which rotates an explosive pellet in line with a detonator. Both of these devices are intended for nuclear warheads and are much more complicated than required for less demanding arming enabling applications.

Specifically, there is a requirement in certain weapon systems for the incorporation of a unique signal device into the arming mechanism for the propulsion system. The present invention was devised to fill the technological gap that has existed in the art in this respect.

SUMMARY OF THE INVENTION

An object of the invention is to provide an improved safety and arming mechanism of simple and efficient construction having particular utility for incorporation into the arming mechanism for the propulsion system of a missile.

Another object of the invention is to provide such an improved safety and arming mechanism that must accept a particular preset coded input signal to function and thereby allow arming.

In accomplishing these and other objectives of the invention, there is provided a unique signal device of the combination lock type comprising a ratchet mechanism and a pair of solenoids for adjusting each of a series of cogwheels in sequence. The application of preset coded signals to the solenoids effects a predetermined alignment of slots or cutouts in the cogwheels which permit passage therethrough of a long bar or rack to allow arming.

The various features of novelty which characterize the invention are pointed out with particularity in the claims annexed to and forming a part of the specification. For a better understanding of the invention, its operating advantages, and specific objects attained by its use, reference is made to the accompanying drawings and descriptive matter in which a preferred embodiment of the invention is illustrated.

BRIEF DESCRIPTION OF THE DRAWINGS

With this description of the invention, a detailed description follows with reference being made to the accompanying figures of drawing which form part of the specification, in which like parts are designated by the same reference numbers, and of which.

DESCRIPTION OF THE PREFERRED EMBODIMENT

Figure 3:
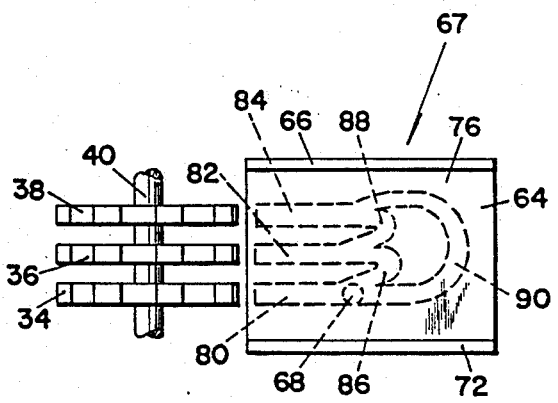
FIG. 3 is a top plan view of the actuator guide structure.

The safety and arming mechanism according to the invention comprises a unique signal device of the combination lock type. This device, designated 10 in the drawings, includes actuating means 11 comprising first and second solenoids 12 and 14, a rocker arm 16 having a first end 18 and a second end 20, and an actuator arm 22 having a first end 24 and a second end 26. Rocker arm 16 is pivoted at a point 28 located substantially centrally of the length thereof.

Each of solenoids 12 and 14 includes a movable armature, with armature 30 of solenoid 12 being pivotally connected to first end 18 of rocker arm 16 and armature 32 of solenoid 14 being pivotally connected to the second end 20 of rocker arm 16 and also to the first end 24 of the actuator arm 22. Each of the solenoids 12 and 14 gives a push stroke to its respectively associated armature 30 and 32 when an electrical signal is applied thereto. Each of the armatures 30 and 32 returns to a null position when the signal power to its individually associated solenoid 12 and 14 is turned off. The attachment of the armature 30 to the rocker arm 16 is such that a push stroke therefrom translates to a pull stroke on the first end 24 of actuator arm 22. On the other hand, a push stroke from the armature 32 results in a push stroke on the first end 24 of actuator arm 22.

Figure 4:
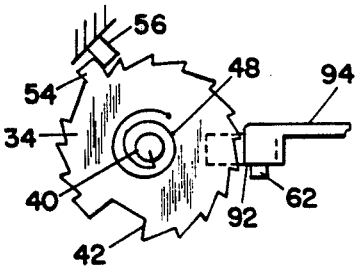
FIG. 4 is a plan view illustrating the starting position of one of a series of cogwheels employed in the safety and arming mechanism.

The device 10 includes three ratchet or cogwheels 34, 36 and 38 which may be of substantially the same size and are positioned for rotation on a shaft 40 in spaced coaxial relationship. Each of cogwheels 34, 36 and 38 has a respectively associated slot or cutout 4, 44 and 46 and is provided with an individually associated spiral biasing spring 48, 50 and 52 for biasing it to an initial or starting position. As illustrated in FIG. 4, a projection 54 on cogwheel 34 is shown, in the starting position thereof, as being in engagement with a fixed abutment 56.

Figure 6:
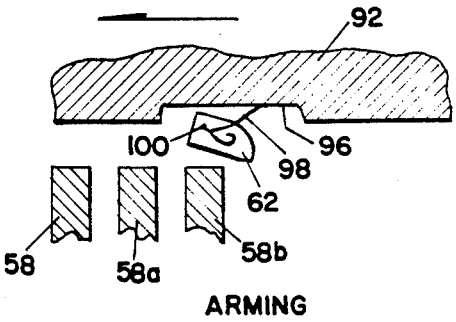
FIG. 6 is a view showing the position of a pawl release lever for the cogwheels with a long bar or arming rack moving in the direction to allow arming.
Figure 7:
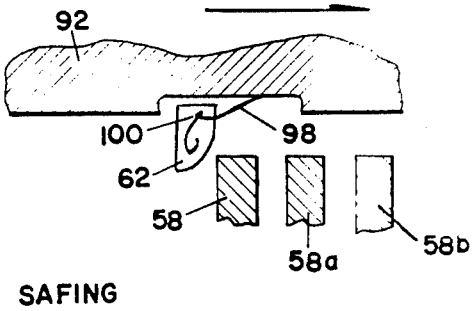
FIG. 7 is a view showing the position of the pawl release lever with the arming rack moving in the safing direction.

Cogwheels 34, 36 and 38 are arranged for sequential rotation in incremental steps by a succession of push strokes by the second end 26 of the actuator arm 22. The cogwheels are so set up that each requires a different number of push strokes to bring the cutouts 42, 46 and 48 into alignment. An individually associated pawl 58, 58*a* and 58*b* retains each of the cogwheels 34 36 and 38, respectively, in such incrementally adjusted position. A compression coil spring 60 biases the pawl 58 into engagement with the cogwheel 34, a similar spring (not shown) being provided to bias each of the pawls individually associated with the cogwheels 36 and 38. A release lever 62 for the pawls, shown in end view in FIGS. 6 and 7, is described hereinafter. Upon release of the pawls by lever 62, each of the cogwheels, 34, 36 and 38 is restored by its individually associated spiral spring 48, 50 and 52 to its starting position.

Figure 1:
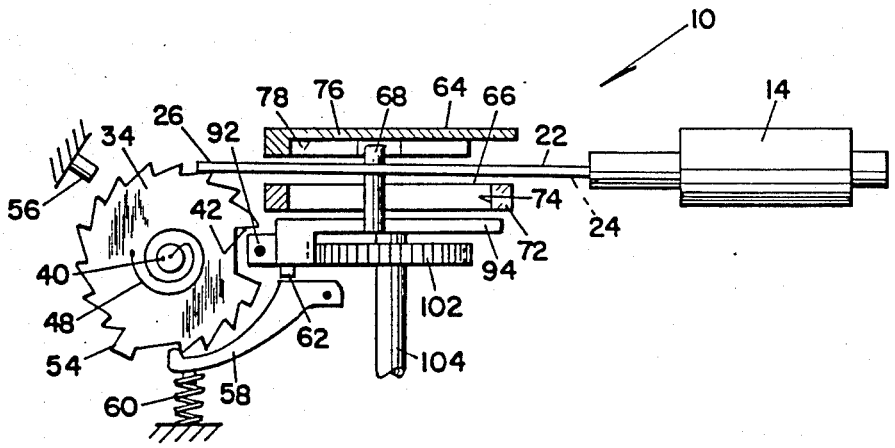
FIG. 1 is a schematic side view of a preferred embodiment of the invention, with the safety and arming mechanism shown in the arming enabling condition.
Figure 2:
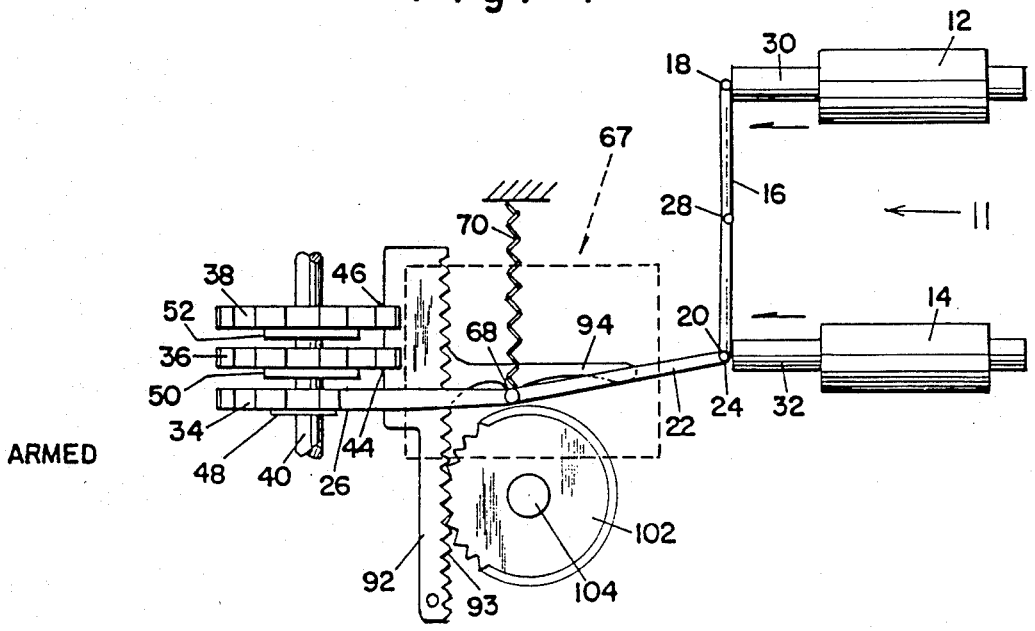
FIG. 2 is a plan view of the safety and arming mechanism of FIG. 1 with a portion thereof, an actuator guide structure, removed.
Figure 5:
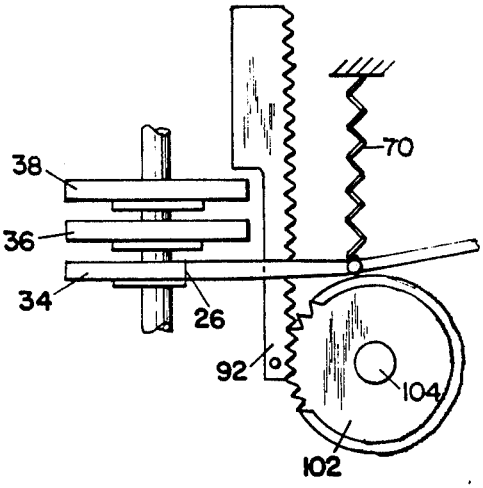
FIG. 5 is a view illustrating the starting position of the safety and arming mechanism.

For effecting sequential adjustment of the cogwheels 34, 36 and 38, a center guide 64 and an outer guide 66 are provided in cooperative relation with a pin 68 carried by the actuator arm 22, as shown in FIGS. 1 and 3. A tension spring 70, as shown in FIGS. 2 and 5, assures that the angular movement of the actuator arm 22 is in the proper direction to bring the second end 26 thereof successively in operative relationship with the cogwheels 34, 36 and 38, in that order. The center guide 64 and the outer guide 66 provide an actuator guide or track means 67, shown in top plan view in FIG. 3 and in phantom in FIG. 2, for the actuator arm 22 and pin 68 to follow as the actuator arm 22 is given push and pull strokes responsively to electrical actuation o solenoids 12 and 14.

Specifically, the outer guide 66 of track means 67 comprises a first plate 72 having a cutout 74 therein. The center guide 64 is positioned above outer guide 66 in spaced relation therewith, as shown in FIG. 1, and comprises a second plate 76 having a groove 78 therein. The spacing is such that the actuator arm 22 is allowed to move freely between the plates 74 and 76, with the upper end of pin 68 extending into groove 78 of plate 76 and the lower end thereof extending downwardly through the cutout 74 in plate 72. The guide track configuration resulting from this arrangement is shown in dotted lines in FIG. 3 and includes three spaced straight tracks indicated therein at 80, 82 and 84. Straight tracks 80, 82 and 84 are disposed in aligning relationship with respectively associated cogwheels 34, 36 and 38, with a curved track 86 leading from track 80 to track 82, a curved track 88 leading from track 82 to track 84, and a curved track 90 leading from track 84 back to track 80.

In the starting condition of the unique signal device 10, the actuator arm 22 is in the position shown in FIG. 5 with the second end 26 of arm 22 disposed in operative relationship with the cogwheel 34, the pin 68 being positioned for movement in straight track 80. Successive push strokes on actuator arm 22 caused by the application of a predetermined number of electrical signals to solenoid 14 result in incremental angular step adjustments of cogwheel 34 until the cutout 42 therein is in a predetermined position in line with an elongated arming enabling bar or rack 92 having teeth 93 along an elongated edge thereof.

With the cogwheel 34 having been so adjusted, the application then of an electrical signal to solenoid 12 results in a pull stroke on actuator arm 22 which, because of the bias force of tension spring 70, causes the pin 68 to be guided around curved track 86 into line with straight track 82. This action places the second end 26 of actuator arm 22 into operative relationship with cogwheel 36. Subsequent successive push strokes resulting from a predetermined number of electrical signals applied to solenoid 14 cause the cogwheel 36 to be incrementally angularly adjusted until the cutout 44 therein also is in a predetermined position in line with the arming rack 92.

The subsequent application of an electrical signal to the solenoid 12 results in a pull stroke on actuator arm 22 that, again due to the bias of tension spring 70, causes the pin 68 to be guided around curved track 88 into line with the straight track 84, thus placing the second end 26 of actuator arm 22 into operative relationship with cogwheel 38. Successive push strokes on actuator arm 22 resulting from a predetermined number of signals applied to solenoid 14 cause the cogwheel 38 to be incrementally angularly adjusted until the cutout 46 therein is in a predetermined position in line with the arming rack 92.

When all three cogwheels have been so adjusted that the cutouts 42, 44 and 46 are all in alignment with the arming rack 92, the latter can be moved from the starting position shown in FIG. 5 to the arming enabling position, as illustrated in FIG. 2.

The mechanism is reset to the starting condition by a reset arm 94 that is fixedly attached to the arming rack 92. During the first portion of the arming enabling motion, a signal is applied to the solenoid 12 causing tee latter to apply a pull stroke to the actuator arm 22. This pulls the actuator arm 22 back enough to allow the reset arm 94 to push the pin 68 around the curved track 90 and thereby to move the actuator arm 22 to the starting position. To that end, as best seen in FIG. 1, the pin 68 extends downwardly through the cutout 74 in plate 72 into the path of movement of the reset arm 94. In the starting position, the pin 68 is positioned in the straight track 80 and the actuator arm 22 is positioned in alignment with cogwheel 34.

The pawl release lever 62, to which reference has been made previously herein, is mounted in a recess 96 in arming rack 92. Specifically, lever 62 is attached to rack 92 by a spring wire hinge 98. Hinge 98 is fixedly attached at one end in recess 96 to rack 92 and at the other end to lever 62 with an intermediate portion wound around a pin 100 carried by lever 62, as shown in FIGS. 5 and 6.

With the arming enabling rack 92 moving in the arming enabling direction, as shown in FIG. 6, the release lever 62 tilts and rides up on each of the pawls, in turn, being unable to overcome the force of the associated biasing compression coil pawl spring. Thus, each of the pawls retains its individually associated cogwheel 34, 36 or 38 locked in place during movement of the rack 92 in the arming enabling direction.

When the arming enabling rack 92 is moving in the opposite or safing direction, as illustrated in FIG. 7, the release lever 62 is locked upright and pushes each of the pawls in turn, out of engagement with its associated pawl against the force of the individually associated compression coil spring biasing the pawl. Thus, as the arming enabling rack 92 is moved in the safing direction, each of the cogwheels 34, 36 and 38 is released and unwinds to its start position, as illustrated in FIG. 4.

A suitably mounted gear wheel 102 mounted for rotation on a shaft 104 and having teeth in operative engagement with the teeth 93 on rack 92 is provided, as shown in FIG. 2, for effecting the arming enabling movements of the rack 92 when the cogwheel cutouts 42, 44 and 46 are all in alignment therewith and also for effecting the safing movements thereof. Gear wheel 102 may be rotated by hand or may be motor driven, in each case by means not shown but well known in the art.

Thus, in accordance with the invention, there has been provided a safety and arming mechanism comprising a unique signal device of the combination lock type The device has particular utility for incorporation into the arming system for the propulsion system of a rocket. The device must accept a particular preset coded input signal to function. When the correct signal has been received, the device will allow arming.

With this description of the invention in detail, those skilled in the art will appreciate that modifications may be made to the invention without departing from the spirit thereof. Therefore, it is no intended that the scope of the invention be limited to the specific embodiment illustrated and described. Rather, it is intended that the scope of the invention be determined by the appended claims.

What is claimed is:

1. Safety arming mechanism comprising, an actuator arm, said actuator arm having a first end and a second end, actuating means for giving pull and push strokes to said actuator arm, said actuating means including a rocker arm having a first end and a second end with said second end of said rocker arm being pivotally connected to said first end of said actuator arm, said rocker arm being pivoted at a position intermediate the ends thereof, said actuating means further including means for selectively giving push strokes to said first end and to said second end of said rocker arm, with a push stroke on said second end of said rocker arm resulting in a push stroke on said first end of said actuator arm and a push stroke on said first end of said rocker arm being translated to a pull stroke on said first end of said actuator arm, track means for guiding the movement of said actuator arm when given pull and push strokes, said track means including a plurality of straight track sections and a curved section between each of said straight sections, a series of spaced coaxial cogwheels each of which has a cutout therein, said second end of said actuator arm being disposed in operative relation with said cogwheels with an individually associated one of said straight track sections being in alignment with each of said cogwheels, means biasing said actuator arm to follow a curved section to the adjacent straight track section each time said actuator arm is given a pull stroke, and an elongated bar, said actuator arm being disposed in operative relation with said track means and said cogwheels such that each pull stroke thereof by said actuator means moves said actuator arm sequentially from one cogwheel to the adjacent cogwheel in the series of cogwheels and each push stroke thereon rotates by a step the cogwheels with which the actuator arm is then in operative relation, said cogwheels being so arranged that each requires a different number of rotative steps to bring its cutout in alignment with the cutouts in the other cogwheels, whereby when each of the cogwheels has been rotated a predetermined number of steps prescribed by a secret code, the cutouts in the series of cogwheels are aligned to permit passage therethrough of said elongated bar that can then allow arming.

2. Safety and arming mechanism as defined by claim 1 wherein said actuating means further includes a first solenoid and a second solenoid with each of said solenoids having an individually associated movable armature, the armature of said first solenoid being connected to the first end of said rocker arm and the armature of said second solenoid being connected to the second end of said rocker arm and to said first end of said actuator arm, each of said solenoids being characterized in that energization thereof results in a push on the end of the rocker arm to which the armature thereof is attached.

3. Safety and arming mechanism as defined in claim 2 wherein said actuator arm includes an attached pin disposed in cooperative relation with said track means.

4. Safety and arming mechanism comprising, an actuator arm, said actuator arm having a first end and a second end, actuating means for giving pull and push strokes to said actuator arm, said actuating means comprising a first solenoid and a second solenoid with each of said solenoids having an individually associated movable armature and a rocker arm pivoted at an intermediate position thereof, the armature of said first solenoid being connected to the first end of said rocker arm and the armature of said second solenoid being connected to the second end of said rocker arm and to said first end of said actuator arm, each of said solenoids being characterized in that energization thereof results in a push on the end of the rocker arm to which the armature thereof is attached with a push on said first end of said rocker arm being translated to a pull on the first end of said actuator arm whereby energization of said first solenoid gives a pull stroke to said actuator arm and energization of said second solenoid gives a push stroke thereto, track means for guiding the movement of said actuator arm when given pull and push strokes, a series of spaced coaxial cogwheels each of which has a cutout therein, wherein said track means includes an individual straight track section in alignment with each of said cogwheels and a curved section between each of said straight sections, wherein the second end of said actuator arm is disposed in operative relation with said cogwheels and said actuator arm includes an attached pin disposed in cooperative relation with said straight and curved sections of said track means, further including spring tension means for biasing said actuator arm to follow each curved section to the adjacent straight section each time said actuator arm is given a pull stroke, and an elongated bar, said actuator arm being disposed in operative relation with said track means and said cogwheels such that each pull stroke thereon by said actuating means moves said actuator arm sequentially from one cogwheel to the adjacent cogwheel in the series of cogwheels and each push stroke thereon rotates by a step the cogwheel with which the actuator arm is then in operative relation, said cogwheels being so arranged that each requires a different number of rotative steps to bring its cutout in alignment with the cutouts in the other cogwheels, whereby when each of the cogwheels has been rotated a predetermined number of steps prescribed by a secret code, the cutouts in the series of cogwheels are aligned to permit passage therethrough of said elongated bar that can then allow arming.

5. Safety and arming mechanism as defined by claim 4, wherein one of said curved sections of said track means connects the straight sections aligned with the first and last of the cogwheels in the series thereof.

6. Safety and arming mechanism as defined by claim 5 wherein said track means comprises a center guide and an outer guide with said center guide being positioned sufficiently far above said outer guide to allow said actuator arm to move therebetween, said outer guide comprising a first plate having a cutout therein defining the outer limits of said track means, and said center guide comprising a second plate parallel with said first plate and having a groove therein defining said straight sections and said curved sections.

7. Safety and arming mechanism as defined by claim 6 further including means for resetting said mechanism to its initial condition comprising a reset arm attached to said elongated bar and movable in a path parallel to the path of movement of said actuator arm as said elongated bar is passed through the aligned cutouts of said cogwheels, and wherein said pin carried by said actuator arm extends downwardly through the cutout in said first plate of said track means into the path of movement of said reset arm and is engaged thereby as said elongated bar is moved to a position allowing arming.

8. Safety and arming mechanism as defined by claim 7 wherein each of said cogwheels includes an individually associated spiral spring means biasing it to an initial position, wherein said elongated bar includes a recess, and further including pawl means for retaining each of said cogwheels in the rotative position to which it is adjusted by the actuator arm, pawl biasing spring means biasing said pawl means into engagement with said cogwheels, and a release lever for said pawl means, said release lever being mounted in said recess in said elongated bar and so suspended therein that on movement of the elongated bar in the arming direction said release lever tilts and is unable to overcome said pawl biasing spring means biasing said pawl means into engagement with said cogwheels but is operative upon movement of the elongated bar in the safing direction to overcome the pawl biasing spring means biasing said pawl means thereby to effect the release of each of said cogwheels and the return thereof by the spiral spring means individual thereto to said initial position.

9. Safety and arming mechanism as defined by claim 8 wherein said release lever is suspended by a hinge wire fixedly attached in the recess in said elongated bar.

10. Safety and arming mechanism as defined by claim 9 wherein said elongated bar comprises a rack having teeth along an edge thereof, and further including a gear wheel having teeth in engagement with the teeth on said rack for moving said rack when the cutouts in said cogwheels are aligned to allow movement of said rack therethrough.

11. Safety and arming mechanism responsive to electrical signals comprising, a first solenoid, a second solenoid, each of said first and second solenoids having an individually associated armature, an actuator arm having a first end and a second end, a rocker arm pivoted at an intermediate position thereof and having a first end and a second end, the armature of said first solenoid being connected to the first end of said rocker arm and the armature of said second solenoid being connected to the second end of said rocker arm and to said first end of said actuator arm, track means for guiding said actuator arm, a series of coaxial cogwheels each of which has a cutout therein, wherein said track means includes an individual straight track section in alignment with each of said cogwheels and a curved section between each of said straight sections, an elongated bar, said first solenoid and said second solenoid being disposed in operative relation with said rocker arm and said actuator arm such that said first solenoid and said second solenoid give a pull stroke and a push stroke, respectively, to the first end of said actuator arm when an electrical signal is applied thereto, further including means for biasing said actuator arm to follow each curved section to the adjacent straight section each time said actuator arm is given a pull stroke, said actuator arm being disposed in operative relation with said track means and said cogwheels such that each pull stroke thereon moves the second end of said actuator arm sequentially from one cogwheel to the adjacent cogwheel in the series of cogwheels and each push stroke thereon rotates by a step the cogwheel with which the actuator arm is then in operative relation, said cogwheels being so arranged that each requires a different number of rotative steps to bring its cutout into alignment with the cutouts in the other cogwheels, whereby when each of the cogwheels has been rotated a predetermined number of steps prescribed by a secret code the cutouts in the series of cogwheels are aligned to permit passage therethrough of said elongated bar that can then allow arming.

12. Safety and arming mechanism as defined in claim 11 wherein said actuator arm includes an attached pin positioned in cooperative relation with said track means.

13. Safety and arming mechanism as defined in claim 12 further including spring tension means for biasing said actuator arm to follow each curved section of said track means to the adjacent straight section each time said actuator arm is given a pull stroke.

14. Safety and arming mechanism as defined by claim 13 wherein one of said curved sections of said track means connects the straight sections aligned with the first and last of the cogwheels in the series thereof.

15. Safety and arming mechanism as defined by claim 14 wherein said track means comprises a center guide and an outer guide with said center guide being positioned above said outer guide and spaced sufficiently far away therefrom to allow said actuator arm to move freely therebetween, said outer guide comprising a first plate having a cutout therein defining the outer limits of said track means and said center guide comprising a second plate parallel with said first plate and having a groove therein defining said straight sections and said curved sections.

16. Safety and arming mechanism as defined by claim 15 further including means for resetting said mechanism to its initial condition comprising a reset arm attached to said elongated bar and movable in a path parallel to the path of movement of said actuator arm as said elongated bar is passed through the aligned cutouts of said cogwheels, and wherein said pin carried by said actuator arm extends downwardly through the cutout in said first plate of said track means into the path of movement of said reset arm and is engaged thereby as said elongated bar is moved to a position allowing arming.

17. Safety and arming mechanism as defined by claim 16 wherein each of said cogwheels includes an individually associated spring means biasing it to an initial position, wherein said elongated bar includes a recess, and further including pawl means for retaining each of said cogwheels in the rotative position to which it is adjusted by the actuator arm, pawl biasing spring means biasing said pawl means int engagement with said pawl means, and a release lever for said pawl means, said release lever being mounted in said recess in said elongated bar and so pivoted therein that on movement of the elongated bar in the arming direction said release lever tilts and is unable to overcome said pawl biasing spring means biasing said pawl means into engagement with said cogwheels but is operative upon movement of the elongated bar in the safing direction to overcome the spring means biasing said pawl means thereby to effect the release of each of said cogwheels and the return thereof to by the said spring means individual thereto to said initial position.

18. Safety and arming mechanism as defined by claim 17 wherein said release lever is mounted on a hinge located in the recess in said elongated bar.

19. Safety and arming mechanism as defined by claim 18 wherein said elongated bar comprises a rack having teeth along an edge thereof, and further including a gear wheel having teeth in engagement with the teeth on said rack for moving said rack when the cutouts in said cogwheels are aligned to allow movement of said rack therethrough.

* * * * *